US011260557B2

(12) United States Patent
Winter

(10) Patent No.: US 11,260,557 B2
(45) Date of Patent: Mar. 1, 2022

(54) PRESS DIE AND METHOD FOR PRODUCING A ROOF TILE

(71) Applicant: Monier Roofing GmbH, Oberursel (DE)

(72) Inventor: Frank Winter, Bad Salzdetfurth (DE)

(73) Assignee: MONIER ROOFING GMBH

( * ) Notice: Subject to any disclaimer, the term of this patent is extended or adjusted under 35 U.S.C. 154(b) by 423 days.

(21) Appl. No.: 16/324,013

(22) PCT Filed: Aug. 3, 2017

(86) PCT No.: PCT/EP2017/069716
§ 371 (c)(1),
(2) Date: Feb. 7, 2019

(87) PCT Pub. No.: WO2018/029092
PCT Pub. Date: Feb. 15, 2018

(65) Prior Publication Data

US 2019/0160705 A1 May 30, 2019

(30) Foreign Application Priority Data

Aug. 8, 2016 (DE) ..... 10 2016 114 653.6

(51) Int. Cl.
*B28B 3/00* (2006.01)
*B30B 15/02* (2006.01)
*B28B 3/02* (2006.01)

(52) U.S. Cl.
CPC ..... *B28B 3/003* (2013.01); *B28B 3/024* (2013.01); *B30B 15/024* (2013.01)

(58) Field of Classification Search
CPC ..... B28B 3/003; B28B 3/024; B28B 3/086; B28B 7/00; B30B 15/024
See application file for complete search history.

(56) References Cited

U.S. PATENT DOCUMENTS 1,768,546 A 7/1930 Curtis
2,918,715 A 12/1959 Rossi
(Continued)

FOREIGN PATENT DOCUMENTS

AT 124409 B * 9/1931
AT 124409 B 9/1931
(Continued)

OTHER PUBLICATIONS

Office Action dated Jul. 9, 2020 in corresponding Chilean Patent Application No. 201900313.
(Continued)

*Primary Examiner* — Jacob T Minskey
*Assistant Examiner* — Virak Nguon
(74) *Attorney, Agent, or Firm* — Ostrolenk Faber LLP

(57) ABSTRACT

A press die for producing a clay roof tile, including a first die half and a second die half, which can move between a pressing position, in which they define a receiving space that represents the form of the finished roof tile, and a filling position, in which they are mutually spaced and the receiving space can be filled with a plastically deformable clay material. At least one of the first and the second die half has at least one depression which represents a projecting part of the finished roof tile; a first compression element is provided at the depression, and movable between an initial position, in which it is retracted in relation to the form of the finished roof tile, and a compacting position, in which some sections of the first compression element represent the surface of the finished roof tile.

21 Claims, 5 Drawing Sheets

(56) References Cited

U.S. PATENT DOCUMENTS

| | | | | | |
|---|---|---|---|---|---|
| 3,765,810 | A * | 10/1973 | Smarook | B29C 67/20 | 425/110 |
| 5,443,778 | A * | 8/1995 | Schlingman | B29C 45/34 | 264/257 |
| 5,786,003 | A * | 7/1998 | Debbia | B30B 5/02 | 425/405.1 |
| 6,030,576 | A * | 2/2000 | Cassani | B28B 3/003 | 264/109 |
| 2003/0049349 | A1 * | 3/2003 | Rivola | B28B 3/003 | 425/405.2 |

FOREIGN PATENT DOCUMENTS

| | | | | | |
|---|---|---|---|---|---|
| CH | 311124 | | 11/1955 | | |
| CL | 199801804 | | 2/1999 | | |
| DE | 195 26 849 | A1 | 3/1996 | | |
| DE | 103 26 126 | A1 | 7/2004 | | |
| DE | 10326106 | A1 | 12/2004 | | |
| EP | 1990165 | A2 * | 11/2008 | B30B 5/02 | |
| FR | 2 495 604 | A1 | 6/1982 | | |
| JP | 06122112 | A * | 5/1994 | B28B 7/20 | |
| JP | H06-122112 | A | 5/1994 | | |
| JP | 2003-320513 | A | 11/2003 | | |

OTHER PUBLICATIONS

International Search Report dated Jan. 10, 2018 in corresponding PCT International Application No. PCT/EP2017/069716.
Written Opinion dated Jan. 10, 2018 in corresponding PCT International Application No. PCT/EP2017/069716.
Examination Report dated Mar. 14, 2018 in corresponding German Patent Application No. 10 2016 114 653.6.

* cited by examiner

PRESS DIE AND METHOD FOR PRODUCING A ROOF TILE

CROSS-REFERENCE TO RELATED APPLICATIONS

The present application is a 35 U.S.C. §§ 371 national phase conversion of PCT/EP2017/069716, filed Aug. 3, 2017, which claims priority to German Patent Application No. 10 2016 114 653.6, filed Aug. 8, 2016, the contents of both of which are incorporated herein by reference. The PCT International Application was published in the German language.

TECHNICAL FIELD

The invention relates to a press mold for producing a roof tile and to a method for producing a roof tile.

BACKGROUND OF THE INVENTION

Roof tiles are usually produced using the wet pressing method. In this method, clay and loam are extracted from a pit, subsequently mixed, processed, and stored in a sump house, fully prepared for production. From the processed clay mixture, first of all an endless clay column is extruded by an extrusion press, said clay column subsequently being cut into what are known as slugs. In a revolving press, into which plaster molds for respectively molding the top side and underside of the roof tile have been introduced, the slug is given a shape corresponding to the roof tile. Following the pressing operation, the roof tile already has what is known as green strength, which makes it possible to remove the green roof tile from the plaster mold, to stack it on a drying frame and feed it for drying in this state. The green roof tile is dried over a period of 24 to 60 hours at a temperature of preferably between 80° C. and 120° C. In the process, the moisture content of the roof tile generally reduces to less than 4%. If the surface of the roof tile is intended to be engobed or glazed, in order to achieve different colors, the roof tiles are first of all separated for the surface coating, then placed on tile cranks and subsequently stacked together with the tile cranks in the tunnel kiln car. The firing operation takes place in the tunnel kiln over a period of 24 to 36 hours at a temperature of between 980° C. and 1100° C. The fired roof tiles are then unloaded from the tunnel kiln car, detached from the tile cranks and fed for packaging.

In order to comminute the constituents of the clay and the loam during raw-material processing, to homogenize same and in order to later obtain a clay mixture that is plastically deformable for the extrusion operation, water is added to the clay mixture several times. The clay stored in the sump house has a moisture content of about 15% to 18%, which is increased to 18% to 20% by further addition of water shortly before the extrusion press.

During the pressing operation, it is necessary to ensure that the water combined with the clay mixture can escape from the clay and from the press mold. If the water does not escape, it remains in the clay mixture and leaves pores in the fired roof tile, which reduce the freeze thaw resistance of the roof tile. Therefore, the press molds are produced from plaster and equipped with drainage lines so that water can be withdrawn from the clay on account of the hygroscopic properties of the plaster. The service lives of plaster molds are short, and so the plaster molds of the revolving press have to be replaced frequently, resulting in production interruptions. Moreover, the separate production of the plaster molds is labor-intensive and expensive.

A further drawback is that, after pressing, the roof tile still has a high moisture content of around 18%. The water still present in the clay has to be withdrawn from the green roof tile again during drying, in order to achieve a moisture content, admissible for the firing operation, of less than 2%. The considerable water withdrawal results in high shrinkage and thus in drying defects and deformations in the roof tiles.

The drying of the roof tiles is also associated with high investment costs, since the acquisition costs of a dryer and the space requirement of such an installation are very high. Furthermore, the charging of the dryer is associated with high handling effort. During operation, the dryer causes considerable energy costs on account of the long drying times and the high drying temperatures.

In order to remedy the drawbacks associated with the wet pressing method, DE 195 26 849 A1 proposes producing roof tiles using the dry pressing method. In this case, the clay from the pit is fed to interim storage via feeders, pan mill, rolling mills and mixers. Granules are then produced from this processed, developed, earth-moist clay, in that first of all thin clay columns are extruded, which, after exiting the extruder, are cut up into small shaped bodies and are covered with dry clay dust, producing moist clay granules with an enormously large surface area, which dry quickly. This results in predried, pourable but still plastically deformable granules, which are pressed in a press to form a green roof tile.

On account of the drying of the granules, the green roof tiles have very low residual moisture content, and so, instead of plaster molds with a short service life, steel press molds can be used. Furthermore, no or only very brief drying of the green roof tiles before the firing operation is necessary. Since the water withdrawal has already taken place before the pressing operation, the main shrinkage takes place in the granules and not, as in wet pressing, during the drying of the green roof tiles. Therefore, drying defects no longer arise, which can become noticeable by warpage during the firing of the roof tiles.

However, the use of steel molds has not proved itself in the production of roof tiles. In order to fulfill their function on the roof, roof tiles usually have protrusions, for example top and side folds, lugs for hanging the roof tile on the roof battens, reinforcement ribs or stacking points. In order to mold the protrusions on the roof tile, the depth of the steel mold in the region of the protrusions has to be much greater than in other regions. Although these recesses in the mold are filled with clay material, for example clay granules, during the filling of the press mold, this clay material is compacted less during the pressing operation. As a result, the roof tiles have lower green strength and greater porosity in the region of the protrusions, such that, during demolding and subsequently on account of freeze thaw effects, crack formation or breaking off of the protrusion can often occur.

SUMMARY OF THE INVENTION

Therefore, the invention is based on the object of providing a press mold and a method for producing a roof tile using the dry pressing method, which allow more uniform compaction of the clay material and thus improve the strength and the resistance of the roof tile with respect to external influences.

In order to achieve the object, in a press mold for producing a roof tile from clay, having a first mold half and a second mold half, wherein the mold halves are movable relative to one another between a pressing position, in which the mold halves substantially delimit a receiving space that models the shape of the finished roof tile, wherein the surface of the first and of the second mold half models in each case a surface of the roof tile, and a filling position, in which the mold halves are spaced apart from one another and a plastically deformable clay material can be filled into the first and/or the second mold half, provision is made for the first and/or the second mold half to have at least one recess that models a protrusion on the finished roof tile, wherein, in and/or on the recess, a first pressure element is provided, which is configured to be movable between a starting position, in which the first pressure element is set back with regard to the shape of the finished roof tile, and a compacting position, in which the first pressure element partially models the surface of the shape of the roof tile.

After the press mold has been closed and the mold halves have been moved into the pressing position, the first pressure element can be moved into the compacting position. As a result, the first pressure element further compacts the clay material in the regions in which insufficient compaction takes place as a result of the moving of the mold halves, for example in recesses that model ribs or protrusions on the finished roof tile. As a result, the strength of the roof tile in these regions can be increased, such that the roof tile exhibits greater strength and resistance with respect to external influences.

During compaction, the pressure element pushes into the surface of the roof tile, with the result that the surface of the roof tile is provided with an impression in the regions that are further compacted. The impression gives the roof tile a characteristic appearance and remains even after the firing operation. Depending on the number, size and arrangement of the pressure elements used, different impression patterns therefore arise on the surface of the roof tile.

After the pressing operation, the first pressure element can be moved back into the starting position, with the result that the pressed roof tile can detach from the respective mold half in the region of the recesses and demolding is rendered easier. The risk of damage to the pressed roof tile by the roof tile sticking to a mold half while it is being removed from the press mold can thus be reduced.

For example, on opposite faces of the recess, in each case at least one first pressure element is provided. The first pressure elements can be arranged in a mirror-symmetric manner with regard to a plane of symmetry of the recess, such that the protrusion is compacted on both sides. In particular, the opposite pressure elements can be coupled to one another in order to ensure that the protrusion is compacted to the same extent on both sides.

The first pressure element can be provided for example at the foot of the recess, that is to say at the transition from the recess to the surface of the mold half. Thus, in the highly loaded regions of the foot of a protrusion, compaction of the clay material takes place, with the result that the stability of the roof tile is increased.

At the surface of the first and/or the second mold half, at least one second pressure element can be provided, which is configured to be movable between a starting position, in which the pressure element protrudes or is set back with regard to the shape of the finished roof tile, and a compacting position, in which the pressure element partially models the surface of the shape of the roof tile. As a result of this second pressure element, for example further compaction of the clay material outside the recesses is possible.

The second pressure element can be coupled to a first pressure element provided in the recess, wherein the coupling is configured such that, when the second pressure element moves from a protruding position into the compacting position, the corresponding first pressure element is urged from the set-back position into the compacting position. In this embodiment, no further compaction takes place in the region of the second pressure element, but rather the second pressure element is used to move the first pressure element into the compacting position. In this case, the second pressure element can be used as a control element. Preferably, the first and the second pressure element are mechanically coupled, however, such that, as a result of the force acting on the second pressure element, the first pressure element moves into the compacting position.

The coupling of first and second pressure elements allows easier control of the movement of the first and the second pressure elements between the respective starting position and the respective compacting position. As a result of the mold halves being moved into the pressing position, pressure is exerted by the clay material on the second pressure element, said pressure moving the second pressure element into the compacting position. As a result of the movement of the second pressure element into the compacting position, the first pressure element, coupled to the second pressure element, is also moved into the compacting position, such that separate control for the first pressure element is not required.

Furthermore, easy demolding of the roof tile from the mold is possible. For example, in the starting position, the second pressure element protrudes with respect to the shape of the finished roof tile and is moved into the compacting position by the pressure that rises during the movement of the mold halves into the pressing position. As a result of the coupling of the first and the second pressure element, the first pressure element is moved into the compacting position. During the opening of the mold, that is to say a movement of the mold halves into the filling position, the pressure on the second pressure elements is reduced, and so the latter can move back into the protruding position, with the result that the pressed roof tile is raised and detached from the surface of the mold. The first pressure element, coupled to the second pressure element, is moved at the same time back into the starting position set back with regard to the shape of the roof tile, with the result that the roof tile can also detach from the respective mold half in the region of the recess. As a whole, the roof tile subsequently does not stick or sticks only slightly to the respective mold half, and so the risk of damage during the removal of the roof tile can be reduced.

Preferably, a plurality of first pressure elements and/or a plurality of second pressure elements are provided, wherein the first pressure elements and/or the second pressure elements are coupled together in an intra-connected and/or interconnected manner. Sufficient compaction of the clay material can be achieved with one pressure element. If a plurality of, preferably small-area pressure elements are used, the compaction can be controlled better, or the pressing operation controlled such that the compaction takes place in each case in a defined region with a defined pressure on the clay material.

In a preferred embodiment, the first pressure element and/or the second pressure element is a pressure pad that has a variable-volume pressure chamber that is fillable with an, in particular incompressible, pressure medium, wherein a pressure line for feeding and/or discharging the pressure medium is provided. A pressure pad can be controlled very readily via the pressure or the volume of the filled-in pressure medium. In addition, such pressure pads are low-maintenance. In particular in the case of pressure pads, the use of a plurality of small-area pressure elements has the advantage that better control of the compaction or targeted compaction in defined regions of the surface of the roof tile is possible. In addition, the wear of the pressure pads can be reduced, since the pressure pads can be dimensioned and arranged such that the pressure pads have no or only few bending points.

The use of the pressure pads also allows easy coupling of first and/or second pressure pads. For example, the pressure lines of at least one first and/or of at least one second pressure pad are connected together. The pressure pads can be connected together by the pressure lines on the principle of communicating pipes. As a result, pressure equalization takes place between the individual pressure pads, such that approximately the same pressure prevails in the pressure pads, with the result that the compaction takes place with the same pressure in the region of the different pads.

For example, the pressure pads form a closed system, in which the pressure medium has been introduced at a slight overpressure of about 5 Pa to 7 Pa. If a higher pressure is exerted on one pressure pad, pressure equalization takes place within the closed system, with the result that the pressure pad is for example pushed in and another pressure pad, on which a lower pressure acts, is raised. For example, in each case a first pressure element in the form of a pressure pad is coupled to a second pressure pad in the form of a pressure pad. Since the second pressure element is arranged at the surface of the mold half, a high pressure is exerted on said second pressure element during the closing of the press mold, such that said pressure pad is pushed in slightly until it is located in the compacting position. A lower pressure acts on the first pressure element, since the latter is arranged in the recess. As a result of the coupling to the first pressure pad, the pressure medium flows into the first pressure pad, such that the latter is raised and is likewise moved into the compacting position. With a closed system, compaction of the clay material in the recesses is thus possible without additional control for the pressure elements.

A further advantage of such coupling of first and second pressure elements in the form of pressure pads resides in easy demolding of the roof tile from the mold. If, after the pressing operation, the pressure is reduced by the mold halves being moved away from one another, the pressure on the second pressure elements decreases. The pressure medium flows out of the first pressure elements back into the second pressure elements. The first pressure elements move back into the filling position, with the result that the pressed roof tile can detach from the respective mold half in the region of the recesses. The pressure medium flowing into the second pressure elements causes the second pressure elements to bulge, such that the roof tile is raised and detached from the surface of the mold halves.

Alternatively or in addition, a pressure generating device for supplying the pressure medium can be provided, wherein at least one pressure line is connected to the pressure generating device. For example, the pressure elements can be connected individually to the pressure generating device in order to be able to control the former individually. In an alternative embodiment, however, it is also possible for a plurality of pressure elements, which are coupled or connected to one another, to be connected jointly to the pressure generating device.

The surface of the first and/or of the second mold half can have a flexible coating. The pressure element can be arranged in particular under the coating and/or be formed at least partially by the coating. The coating can be formed by a membrane or a film and have a surface which prevents or at least reduces any sticking of the clay material, such that it is easier to remove the pressed roof tile from the mold. In addition, by way of the membrane, a surface of the roof tile without steps or shoulders can be produced. It is also possible for a membrane or a coating to be provided only on the mold half that has pressure elements.

The mold halves can have a main body made of metal, in particular tool steel.

In a preferred embodiment, a guide for the first and/or the second mold half is provided, wherein the guide, together with the mold halves, fully delimits the receiving space in the filling position and in the pressing position. As a result, during and after the filling operation, clay material can be prevented from escaping from the receiving space. For example, the clay material can be introduced into the press mold under high pressure such that precompaction can already take place during the filling in of the clay material.

In order to allow air contained in the clay material or in the mold to escape, the press mold can have vent holes. For example, the vent holes are provided between the mold halves and the guide.

Optionally, a filling apparatus for introducing an, in particular predried, clay material can be provided, wherein the filling apparatus has a high-pressure injection device.

The object is furthermore achieved by a method for producing a roof tile from clay, wherein the mold halves are movable relative to one another between a pressing position, in which the mold halves substantially delimit a receiving space that models the shape of the finished roof tile, wherein the surface of the first and of the second mold half models in each case a surface of the roof tile, and a filling position, in which the mold halves are spaced apart from one another and a plastically deformable clay material can be filled into the first and/or the second mold half, characterized in that the first and/or the second mold half has at least one recess that models a protrusion on the finished roof tile, wherein, in and/or on the recess, a pressure element is provided, which is configured to be movable between a starting position, in which the pressure element is set back with regard to the shape of the finished roof tile, and a compacting position, in which the pressure element partially models the surface of the shape of the roof tile. The method has the following steps of:

- providing the press mold, wherein the mold halves are located in the filling position and the at least one first pressure element is located in the starting position,
- filling a predried, granular clay material into the receiving space,
- moving the mold halves into the pressing position, wherein the clay material is compacted,
- subsequently moving the at least one pressure element into the compacting position, wherein the clay material is compacted in the region of the pressure element.

Following completion of the pressing operation, the first pressure element is preferably moved into the starting position. Then the mold halves are moved into the filling position and the roof tile is removed from the press mold.

Preferably, a guide for the first and/or the second mold half is provided, wherein the guide, together with the mold halves, fully delimits the receiving space in the filling position and in the pressing position. The guide can have a plurality of guide parts and, before the mold halves are moved into the filling position, be moved into a demolding position. Clay exhibits, in the dry pressing method, relatively high elastic recovery of the pressed clay material. The elastic recovery is around 0.7-1.0%. If the press mold is opened for removing the pressed roof tile within the guide laterally delimiting the receiving space, the pressed roof tile expands and jams within the guide, with the result that the pressed roof tile can be damaged or is harder to remove from the press mold. In order to avoid such problems, the guide is moved laterally, that is to say parallel to the extension direction of the mold halves, into a receiving position which is spaced apart from the mold halves and in which the pressed roof tile cannot bear against the guide even in the event of elastic recovery of the clay material, such that the roof tile can expand in the extension direction substantially parallel to the surface of the mold halves.

At the surface of the first and/or the second mold half, at least one second pressure element can be provided, which is configured to be movable between a starting position, in which the second pressure element protrudes or is set back with regard to the shape of the finished roof tile, and a compacting position, in which the second pressure element partially models the surface of the shape of the roof tile, wherein, while or after the mold halves are moved into the pressing position, the second pressure element is moved into the compacting position, and following completion of the pressing operation, it is moved back into the starting position.

The second pressure element is preferably coupled to a first pressure element provided in the recess. As a result of the second pressure element being moved from the protruding position into the compacting position, the first pressure element is urged from the set-back position into the compacting position.

The first and/or the second pressure element can be a pressure pad that has a variable-volume pressure chamber that is fillable with an, in particular incompressible, pressure medium, wherein a pressure line for feeding and/or discharging the pressure medium is provided, wherein the pressure elements are moved in each case by the pressure medium flowing into or out of the pressure chamber.

The press mold can have a filling apparatus for introducing an in particular predried clay material, wherein the filling apparatus has a high-pressure injection device and the filling apparatus injects the clay material under high pressure into the receiving space, wherein the clay material is precompacted.

After the clay material has been filled in, the mold halves can be moved into a venting position between the filling position and the pressing position, in which air contained in the receiving space escapes from the receiving space.

The clay material is injected preferably in a direction extending substantially parallel to the surface of the first and/or the second mold half.

The clay material is preferably produced by the following steps of:

providing the moist, unprocessed clay, drying the clay to a defined moisture content, grinding the dried clay into crushed grain in a mill, and separating out the undersize, the grain size of which is below a defined granularity band, and separating out the oversize, the grain size of which is above a defined granularity band.

In principle, in a dry pressing method, the shrinkage associated with the water removal already takes place in the raw material before it is introduced into the press mold. On account of the drying of the clay that has taken place at the start, the clay material has only a low moisture content, as a result of which it is still plastically deformable, however. In this way, the clay material can be filled directly into the press mold without any further addition of water and can be pressed into a roof tile therein. In the method known from the prior art, the clay coming from the pile is first of all processed into granules, however, which are subsequently dried. This step is omitted in the method according to the invention. The clay coming from the pile is dried by heat without any further processing, such that it can subsequently be ground into a clay material of crushed grain.

Compared with agglomerated or sprayed granules, the resultant clay material made of crushed grain has a better mold-filling capacity. Between the individual broken grains there remain large gaps, which are reduced in size only during the pressing operation when the broken grains are pushed into one another. The crushed grain forms between the individual broken grains fewer gaps, which are reduced in size during the pressing operation by the broken grains being pushed into one another. If the microstructure of a roof tile produced according to the invention is compared with that of a roof tile produced from agglomerated or sprayed granules under an electron microscope, it becomes apparent that, in the case of the crushed grain, fewer, but larger pores remain after compaction than in the case of agglomerated or sprayed granules. Moreover, the structure differs. On account of the more angular surface structure of the crushed grain, catching or wedging of the grains also occurs during the pressing operation, resulting in an increased green strength and better sintering of the roof tile.

BRIEF DESCRIPTION OF THE DRAWINGS

Further features, details and advantages of the invention will become apparent from the wording of the claims and from the following description of exemplary embodiments with reference to the drawings, in which:

DESCRIPTION OF PREFERRED EMBODIMENTS

Figure 1:
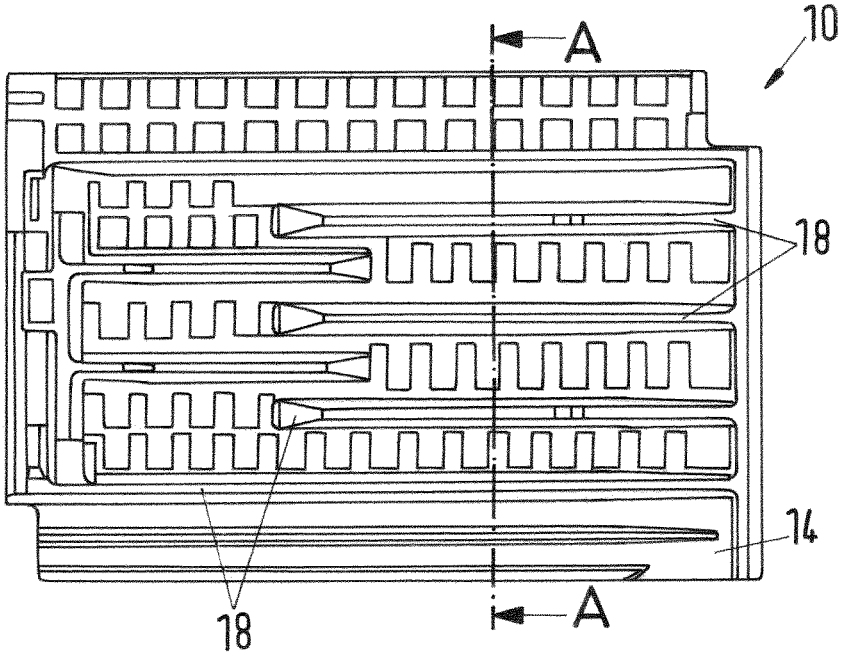
FIG. 1 shows a view of a roof tile that has been produced by a method according to the invention.
Figure 2:
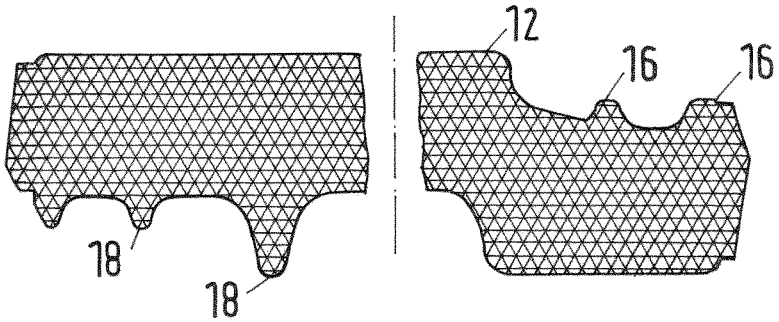
FIG. 2 shows a sectional view of the roof tile from FIG. 1.

FIGS. 1 and 2 show a roof tile 10 made of clay. FIG. 1 shows a view of the underside 14 of the roof tile 10 and FIG. 2 shows a sectional view along the axis A-A in FIG. 1. The roof tile 10 has a top side 12 and an underside 14, wherein, in the embodiment shown here, the top side 12 forms the visible side of the roof tile 10. Formed on the top side 12 of the roof tile 10 are a plurality of protrusions 16. A plurality of protrusions 18 are formed on the underside 14. The protrusions 18 form for example top or side folds, lugs for hanging the roof tile on the roof battens, reinforcement ribs or stacking points. Depending on the type of protrusions, these can extend partially over the underside 14 of the roof tile (see also FIG. 1).

Figure 3:
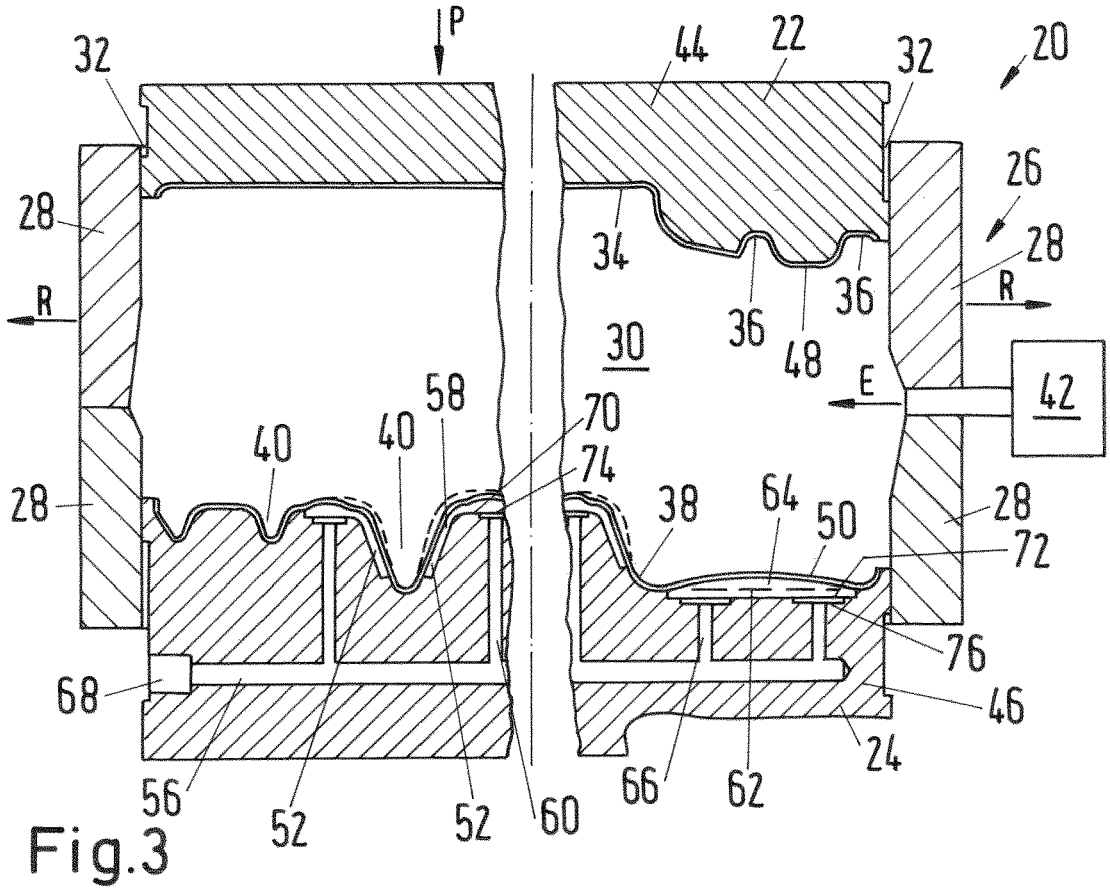
FIG. 3 shows a press mold for producing the roof tile from FIG. 1 in a filling position.
Figure 4:
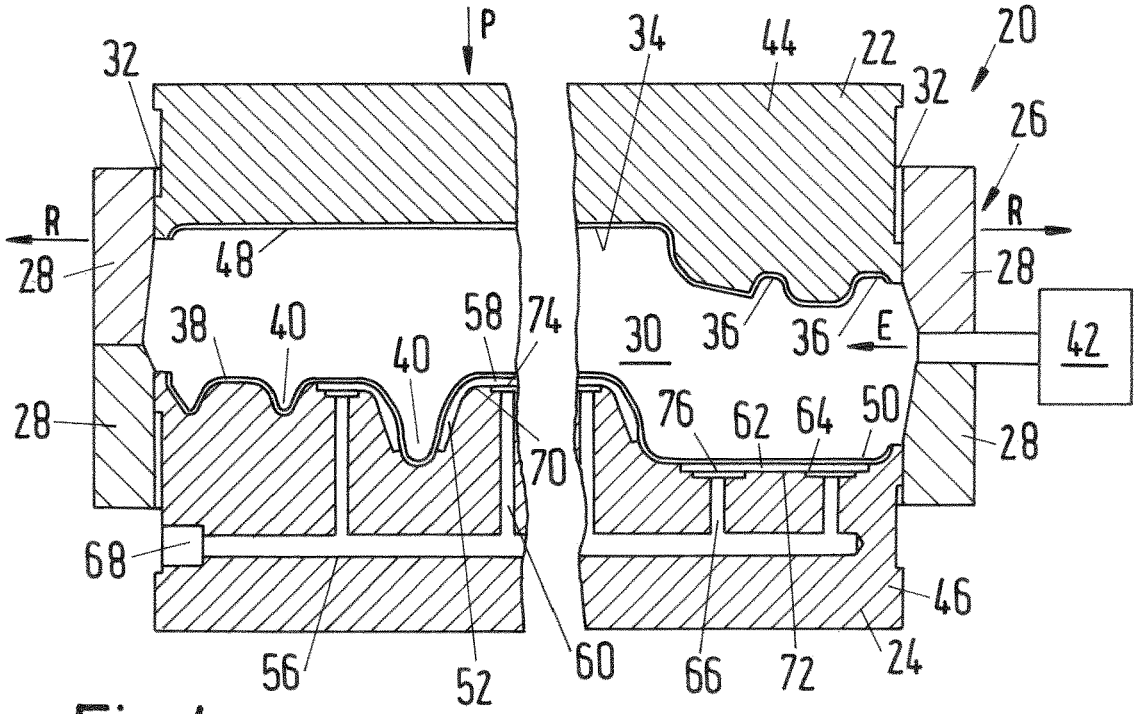
FIG. 4 shows the press mold from FIG. 3 in a closed pressing position.

The roof tile 10 is produced using the press mold 20 shown in FIGS. 3 and 4. Preferably, a dry pressing method is used, in which, as explained below, a predried clay material, for example predried clay granules or predried crushed grain, is used.

The press mold 20 has a first, upper mold half 22 and a lower, second mold half 24. The first mold half 22 forms substantially the top side 12 of the roof tile 10. The second mold half 24 forms substantially the underside 14 of the roof tile 10. Furthermore, a guide 26 having a plurality of guide elements 28 is provided, which, together with the mold halves 22, 24, completely enclose a receiving space 30. Between the mold halves 22, 24 and the guide 26 there are provided only vent holes 32, through which air can escape from the receiving space 30 before and during the pressing operation.

Provided at the surface 34 of the first mold half 22 are a plurality of recesses 36, which model the protrusions 16 on the top side 12 of the roof tile 10. Provided at the surface 38 of the second mold half 24 are a plurality of recesses 40, which, as explained below, model the protrusions 18 on the roof tile 10 in the pressing position of the press mold 20.

In FIG. 3, the press mold 20 is shown in a filling position, in which the mold halves 22, 24 are spaced apart from one another and a clay material can be filled into the receiving space. For filling the press mold 20, a filling apparatus 42 is provided, which can inject the clay material by means of compressed air under high pressure into the receiving space 30. The injection takes place in an injection direction E substantially parallel to the surface 34, 38 of the first and of the second mold half 22, 24, respectively.

From the filling position shown in FIG. 3, the mold halves 22, 24 can be moved toward one another in a pressing direction P, into the pressing position shown in FIG. 3, in which the receiving space 30 models substantially the shape of the roof tile 10. One of the mold halves 22, 24 can be fixed in position, such that only the respectively other mold half 24, 22 is moved. However, it is also possible for both mold halves 22, 24 to be able to be moved and to be moved toward one another during the pressing operation of the roof tile 10.

The guide elements 28 are movable into a removal position, in which the guide elements 28 are spaced apart from the mold halves 22, 24, in a removal direction R extending substantially perpendicularly to the pressing direction P.

The mold halves 22, 24 each have a main body 44, 46 made of steel, preferably of tool steel. Furthermore, the surfaces 34, 38 each have a coating 48, 50, which is formed in each case from a PU layer in the embodiment shown here. The coating 48, 40 reduces the sticking of the filled-in clay material to the surfaces 34, 38 of the mold halves 22, 24.

Provided at or in the recess 40 is a first pressure element 52, which is formed by a pressure pad that has a pressure chamber 58 filled with an incompressible pressure medium 56. The first pressure element 52 has a pressure line 60, through which the pressure medium 56, for example oil, can flow into or out of the pressure chamber 58. The first pressure element 52 is provided at the foot of the recesses 40, that is to say at the transition to the surface 38 of the second mold half 24 that faces the first mold half 22.

Furthermore, at the surface 38 of the second mold half 24, a second pressure element 62 is provided, the structure of which corresponds substantially to the structure of the first pressure element 52. The second pressure element 62 has a pressure chamber 64 and a pressure line 66, which are filled with the pressure medium 56.

The pressure line 66 of the second pressure element 62 is connected to the pressure line 60 of the first pressure element 52, such that the pressure medium 56 can flow between the first and the second pressure element 52, 62. Furthermore, the pressure lines 60, 66 are connected to a pressure generating device 68, which can supply the pressure medium 56 and/or can set the pressure in the pressure lines 60, 66 and the pressure elements 52, 62. Preferably, the pressure medium 56 exhibits a high pressure of about 5 Pa to 7 Pa.

The pressure elements 52, 62 are each formed by a cutout 70, 72 in the main body 46 of the second mold half 24 and the coating 50 configured as a membrane.

In the filling position shown in FIG. 3, the second pressure element 62 bulges, in a starting position, in the direction of the receiving space 30, that is to say protrudes beyond the shape of the finished roof tile 10 (see dashed line). The first pressure element 52 is set back with respect to the shape of the finished roof tile 10 in a starting position in the filling position.

The first and the second pressure element 52, 62 are coupled to one another by the pressure lines 60, 66 such that, as a result of the second pressure element 62 being moved into a compacting position, in which the second pressure element 62 partially models the shape of the finished roof tile, the first pressure element 52 is moved outward into a compacting position, in which the first pressure element 52 likewise models part of the shape of the roof tile 10, by the pressure medium 56 flowing out of the second pressure element 62 and into the first pressure element 52 (see FIG. 4).

Figure 5A:
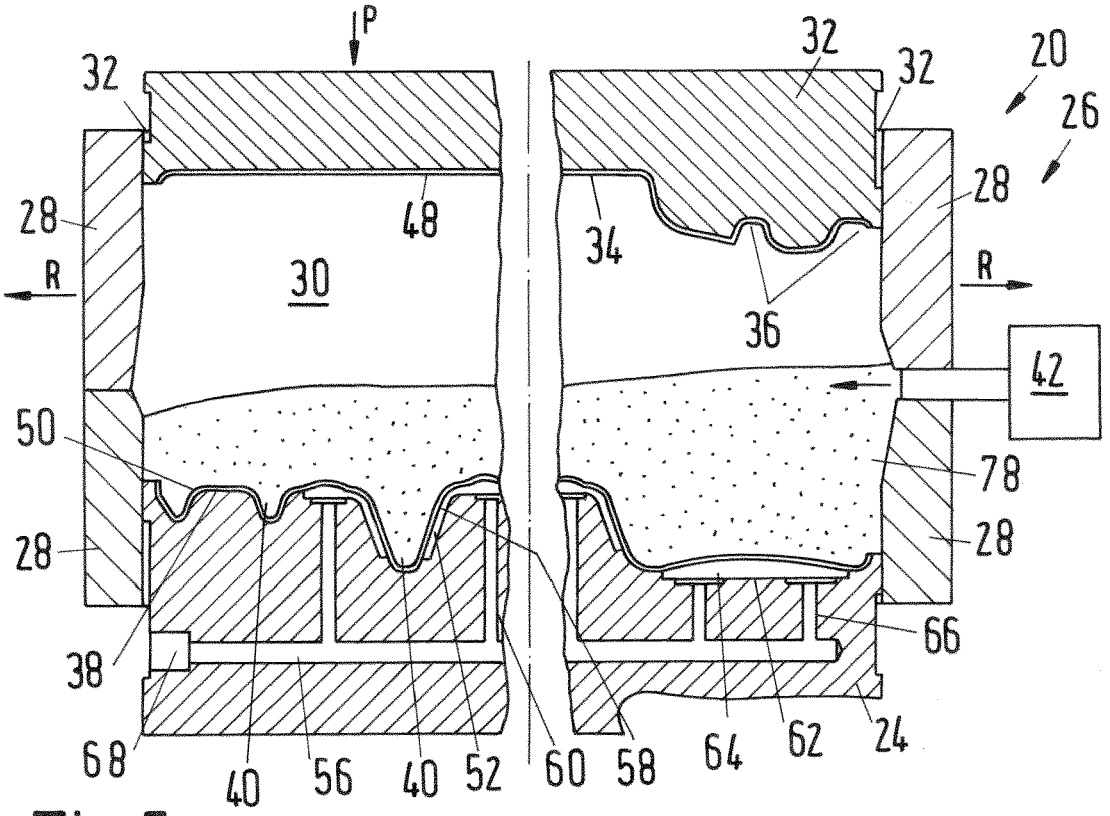
FIGS. 5*a*-5*e* show method steps in a method for producing the roof tile from FIG. 1.

In order to produce a roof tile 10, a predried clay material 78, preferably made of predried, crushed clay, is injected under pressure into the press mold 20 by the filling apparatus 42. The mold halves 22, 24 are each located in the filling position (FIG. 5*a*).

Figure 5B:
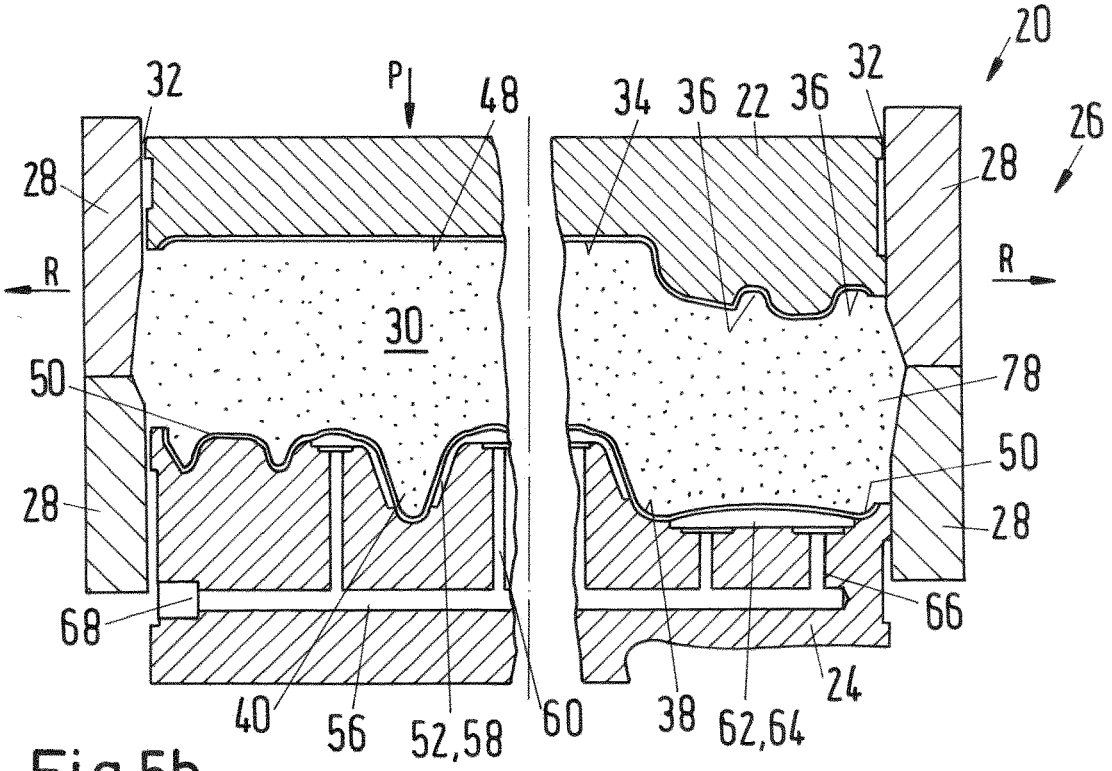

Once the desired quantity of clay material 78 has been introduced into the press mold 20, the mold halves are moved in the pressing direction P into the pressing position, in which the press mold 20 models the shape of the finished roof tile 10 (FIG. 5*b*). While the mold halves 22, 24 are being moved, air contained in the receiving space 30 can escape through the vent holes 32. For example, a venting position can be provided between the filling position and the pressing position, in order to ensure that all of the air escapes from the receiving space 30.

Figure 5C:
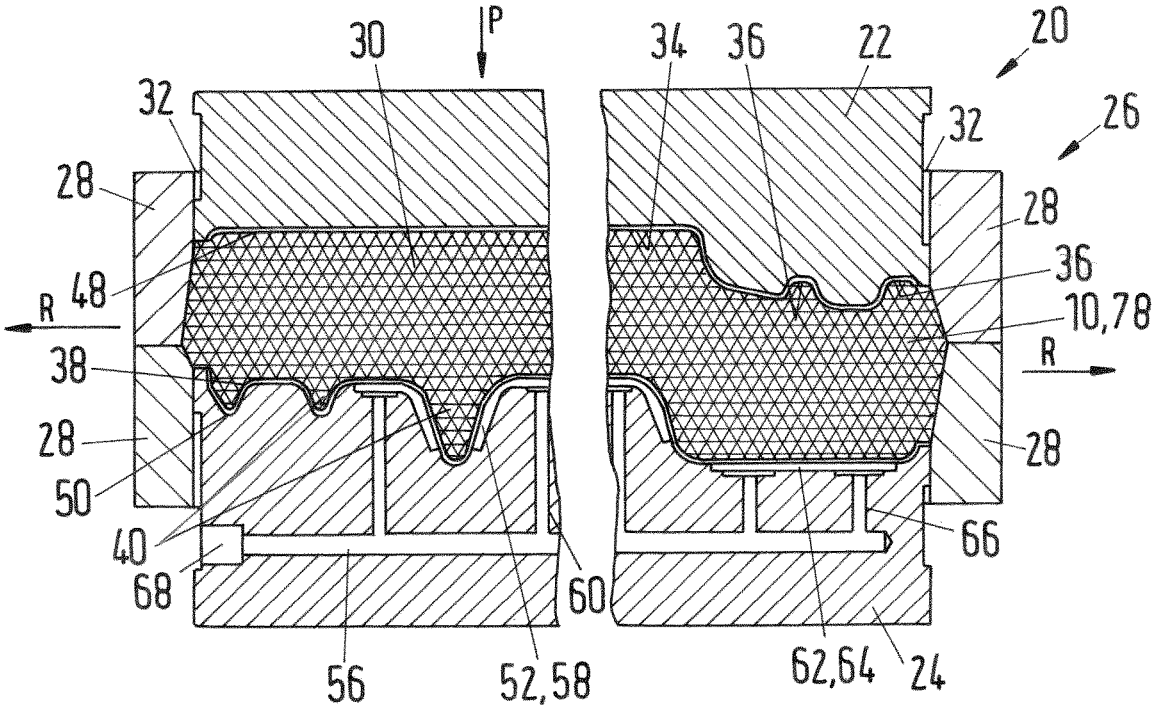

As a result of the mold halves 22, 24 being moved in the pressing direction P, a pressure that acts in the pressing direction P is exerted on the clay material 78, with the result that the clay material 78 is compacted. The pressure also acts on the second pressure element 62 configured as a pressure pad, such that the latter is compressed until it partially models the shape of the finished roof tile 10, that is to say is located in the compacting position (FIG. 5*c*).

As a result of the reduction in volume and the increase in pressure of the second pressure element 62, the pressure medium 56 flows out of the second pressure element 62 and via the pressure lines 60, 66 into the first pressure element 52. In the recesses 40, the pressure generated by the movement of the mold halves 22, 24 is lower, and so the clay material 78 is compacted less and a lower pressure is exerted on the first pressure element 52. The first pressure element 52 can expand as a result and move into the compacting position, in which the first pressure element 52 partially models the shape of the finished roof tile 10.

As a result of the first pressure element 52 moving into the compacting position, an additional pressure is exerted on the clay material 78 in the recess 40, said additional pressure acting substantially transversely to the pressing direction P or perpendicularly to the face of the recess 40 in the region of the first pressure element 52. As a result of this pressure, the clay material 78 is additionally compacted in the region of the recess 40, such that the roof tile 10 has greater strength in this region on account of the greater compaction. The roof tile 10 compacted in this way has high freeze thaw resistance.

Figure 5D:
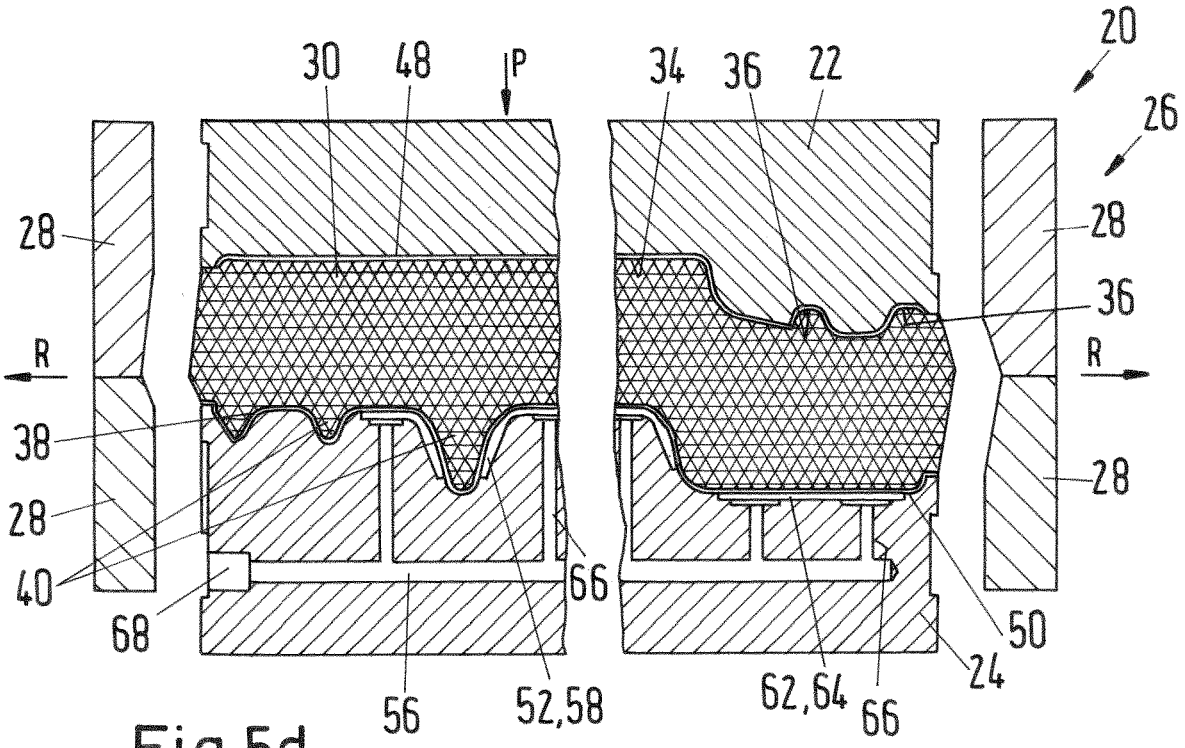

In order to remove the pressed roof tile 10, first of all the guide elements 28 are moved into the removal position (FIG. 5*d*). The clay material used in the dry pressing method has relatively high elastic recovery, which also acts perpendicularly to the pressing direction P. If the mold halves 22, 24 are moved into the filling position, in order to remove the pressed roof tile 10, the roof tile 10 can expand parallel to the surface 34, 38 of the mold halves 22, 24, and so the pressed roof tile 10 could jam against the guide 26. As a result of the guide elements 28 being moved into the removal position, the roof tile 10 can expand in an unimpeded manner.

Figure 5E:
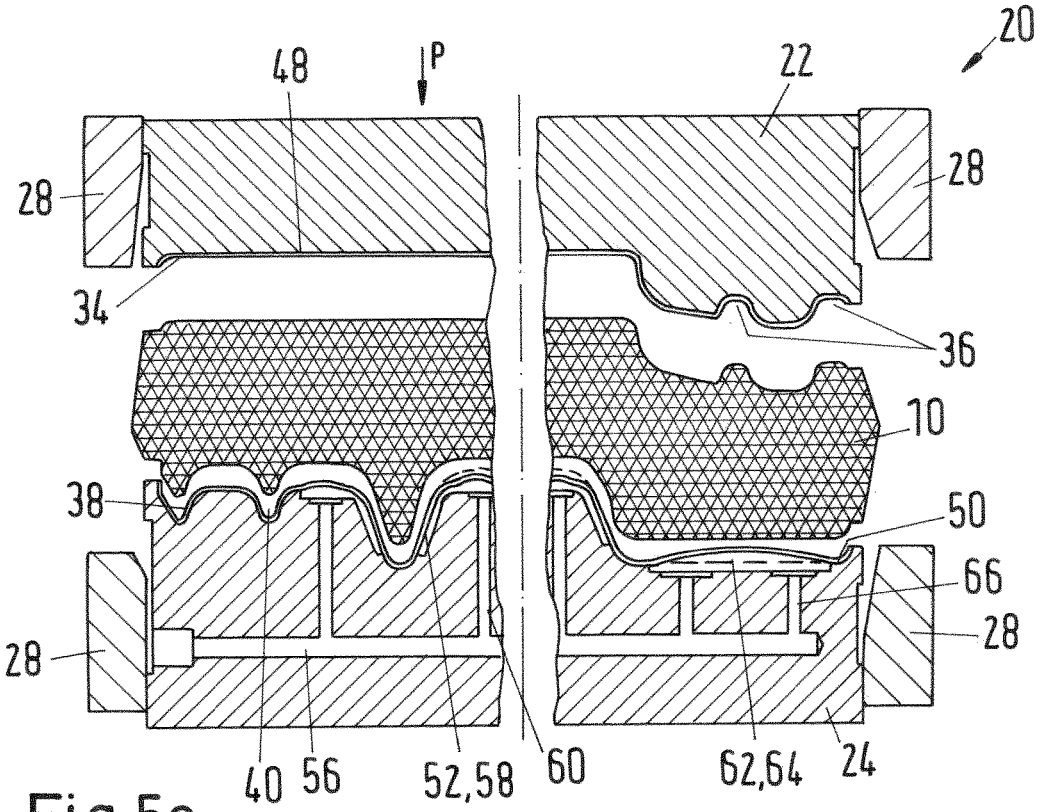

Subsequently, the mold halves 22, 24 are moved counter to the pressing direction P into the filling position. As a result of the mold halves 22, 24 being moved counter to the pressing direction P, the pressure on the clay material 78 and thus on the second pressure element 62 is reduced. The pressure medium 56 can flow at least partially from the first pressure element 52 back into the second pressure element 62 (FIG. 5*e*).

As a result, the first pressure element 52 is moved back into the starting position, in which the first pressure element 52 is set back with regard to the shape of the pressed roof tile 10, with the result that the roof tile 10 can detach from the second mold half in the region of the recess 40. Furthermore, the roof tile 10 is additionally raised by the bulging second pressure element 62, and thus also detaches from the surface 38 of the second mold half 24. The roof tile 10 is thus detached from the surface 38 of the second mold half 24 during the opening of the press mold 20, and so easy removal of the roof tile 10 from the press mold 20 is possible.

By way of the first pressure element 52, the clay material 78 in the region of the recesses 40 is additionally compacted, such that the roof tile 10 has a high level of stability. The second pressure element 62 can additionally apply a structure or an impression to the underside 14 of the roof tile 10.

Figure 1A:
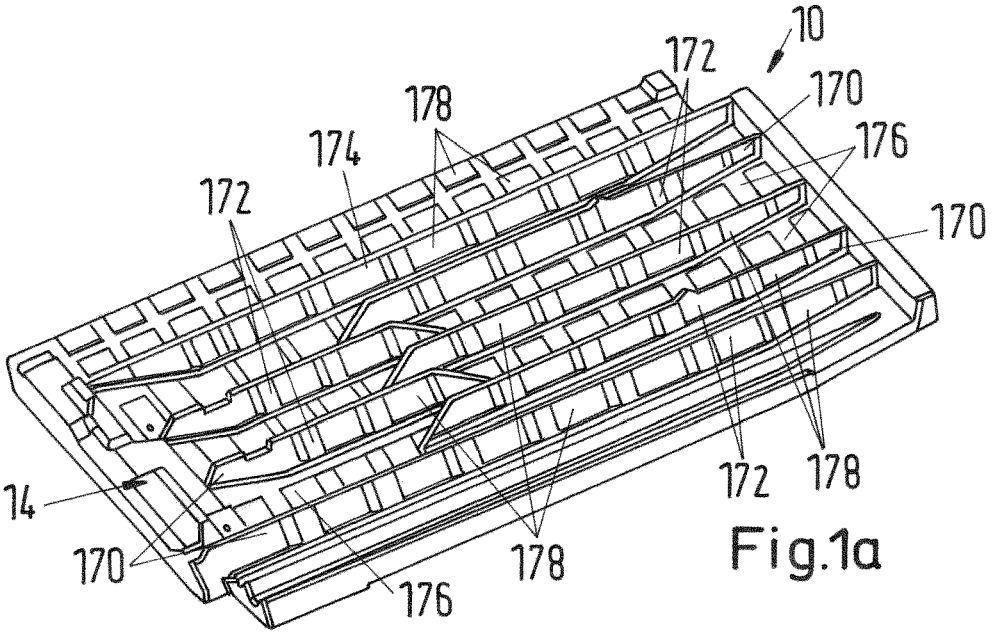
FIG. 1*a* shows a perspective illustration of the impression pattern on the underside 14 of the roof tile.

In FIG. 1*a*, the impression pattern on the underside 14 of the roof tile 10 is illustrated in perspective.

For further compaction, first and second pressure elements 52, 62 were used, wherein the first pressure elements 52 are arranged in the recesses 40 of the mold half 24 such that they can further compact the faces 170 of the roof tile 10 that extend substantially transversely to the pressing direction P. Such faces 170 are located for example at the flanks of the reinforcement ribs 170 or in transition regions 174 to the interlocking joint of the roof tile 10.

The second pressure elements 62, by contrast, are arranged in the planar faces of the press mold 20, such that they lie perpendicularly to the pressing direction P and can further compact the planar faces 176, located for example between the reinforcement ribs 170, of the roof tile 10.

Since each pressure element 52, 62 is pushed into the surface of the roof tile 10 during compaction, a single impression 178 is produced on the surface of the roof tile 10 in each further compacted region.

Depending on the roof tile model, the number, size, shape and arrangement of the pressure elements 52, 62 used can be different. The individual impressions 178 give the roof tile 10 as a whole a characteristic appearance or impression pattern, which remains even after the firing operation.

The top side 12 of the roof tile 10 forms the visible side that is exposed to the weather. Apart from recesses or protrusions 16 that are necessary from a construction point of view, it is therefore configured in as smooth a manner as possible. Since no moving parts and no pressure elements are provided at the surface 34, this surface 34 can optionally also be formed without a coating 48, in order to obtain a top side 12 of the roof tile 10 that is as smooth as possible.

In principle, it is possible to use a large pressure pad or a large first or second pressure element 52, 62. However, if such a large pressure pad extends over corners of the surface 34, 38 of the respective mold half 22, 24, the pressure pad has bending points, which can quickly become worn on account of the high level of loading. In addition, with a large pad, the contour accuracy of the roof tile is harder to achieve. For this reason, a plurality of small pressure pads are used, wherein the pressure lines of the pressure pads can be connected together.

Figure 6:
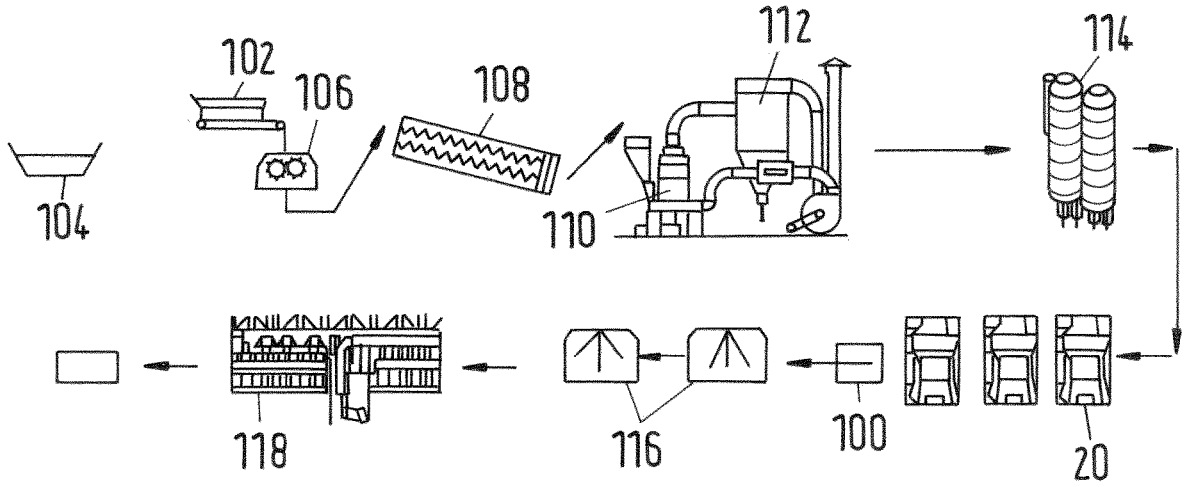
FIG. 6 shows a schematic illustration of an installation for producing the clay material of the roof tile from FIG. 1.

The predried clay material 78 is produced for example in the installation 100 schematically illustrated in FIG. 6, which, together with the press mold 20, is part of a production installation 200 for a roof tile 10.

The installation 100 has a feeding device 102, for example a box feeder, which feeds the unprocessed clay material coming from the pile 104 to the installation 100. Provided downstream of the feeding device 102 is a crushing device 106, which comminutes the clay material into clay lumps with a defined size. The clay lumps preferably have a size of at most 60 mm.

Provided downstream of the crushing device 106 is a dryer 108, which dries the clay lumps. Preferably, the drying takes place such that the clay introduced into the press mold 20 has a residual moisture content of about 2%-4%. The dryer 108 can be any desired dryer. Depending on the drying capacity of the dryer 108, it is also possible for larger clay lumps to be dried, or it is possible to dispense with precomminution.

Provided downstream of the dryer 108 is a mill 110, which grinds the predried clay material to a defined size. The mill 110 is for example a pendulum mill, a bowl mill crusher or an agitator bead mill. Provided in the mill 110 or immediately downstream of the mill 110 is a sorting apparatus 112, in which an undersize, the grain size of which is below a defined granularity band, and an oversize, the grain size of which is above a defined granularity band, are separated out. The granularity band has preferably a grain size of between 0.1 mm and 0.6 mm.

From the sorting apparatus 112, the crushed grain is delivered into a silo 114, in which interim storage of the clay material takes place. In the silo 114, as a result of the interim storage, the crushed clay material is homogenized, such that the latter has a more uniform structure. From the silo 114, the clay material 78 is fed to the press mold 20 and processed into a roof tile 10.

Provided downstream of the press mold 20 are furthermore a glazing and/or engobing device 116, and a firing kiln 118.

The moist, unprocessed clay coming from the pile 104 is precomminuted in the crushing device 106, wherein this precomminution serves only for a quicker and more uniform drying operation. Subsequently, the clay lumps are dried to a defined residual moisture content, which is selected such that the clay material 78 has a residual moisture content of about 2%-4% when it is introduced into the press mold 20. If the clay is immediately processed further into roof tiles, drying to a residual moisture content of about 2% can take place. If interim storage takes place, for example in a silo, during which further drying can take place, the residual moisture content is selected such that the clay has a residual moisture content of about 2%-4% after interim storage, that is to say immediately before the production of the roof tile.

Subsequently, the predried clay lumps are comminuted in the mill 110, a broken grain with a defined granularity band is separated out and is put into interim storage in the silo 114. The undersize can be pelletized or granulated into relatively large granules and fed to the production cycle upstream of the drying kiln 108 or upstream of the mill 110. The oversize can be fed directly to the mill 110 again.

Thus, granules are not produced and subsequently dried; rather the drying takes place before the clay material 78 is comminuted. The crushed grain has an irregular structure, as a result of which the individual grains can mesh together better during the pressing operation. In addition, the crushed grain has a better mold filling capacity. Fewer but larger pores arise, and so the compaction behavior is better.

The invention is not limited to one of the above-described embodiments, but is modifiable in many ways.

For example, a plurality of first pressure elements 52 and/or a plurality of second pressure elements 62 can be coupled to one another. However, it is also possible for only in each case one first pressure element 52 to be coupled to in each case one second pressure element or for a plurality of first or second pressure elements 52, 62 to be coupled to a single second or a single first pressure element 62, 52.

The pressure chambers 58, 64 of the pressure pads are each connected together by the principle of communicating pipes, such that pressure equalization takes place, with the result that the first and second pressure elements 52, 62 are moved into the compacting positions when the mold halves 22, 24 are moved into the pressing position.

Alternatively, the pressure in the pressure elements 52, 62 can also be set by the pressure generating device 68, such that for example the second pressure elements 62 can also be set back with regard to the shape of the pressed roof tile 10 in the starting position and are moved into the compacting position by an increased pressure. In this embodiment, it is possible for further compaction of the clay material 78 likewise to take place for example in the region of the second pressure elements 62. As a result of a reduction of the pressure in the first pressure elements 52 and an increase of the pressure in the second pressure elements 62, the removal operation of the roof tile 10 from the press mold 20 can be rendered easier in this embodiment, too.

For example, it is also possible for only first pressure elements 52 to be provided, which are coupled to a pressure generating device 68.

Instead of the pressure pads shown in FIGS. 3 and 4, it is also possible for other pressure elements 52, 62 to be used, wherein the first and the second pressure elements 52, 62 can be coupled to one another hydraulically or via a controller.

All of the features and advantages, including structural details, spatial arrangements and method steps, that emerge from the claims, the description and the drawing can be essential to the invention both on their own and in a wide variety of combinations.

LIST OF REFERENCE SIGNS

10 Roof tile
12 Top side of the roof tile
14 Underside of the roof tile
16 Protrusions on the top side of the roof tile
18 Protrusions on the underside of the roof tile
20 Press mold
22 Mold half
24 Mold half
26 Guide
28 Guide elements
30 Receiving space
32 Vent holes
34 Surface
36 Recess
38 Surface
40 Recesses
42 Filling apparatus
44 Main body
46 Main body
48 Coating
50 Coating
52 Pressure element
54 Pressure medium
56 Pressure chamber
58 Pressure line
60 Pressure element
62 Pressure element
64 Pressure chamber
66 Pressure line
66 Pressure lines
68 Pressure generating device
70 Cutout
72 Cutout
74 Protective element
76 Protective element
78 Clay material
100 Installation
102 Feeding device
104 Pile
106 Crushing device
108 Dryer
110 Mill
112 Sorting apparatus
114 Silo
116 Glazing and/or engobing device
118 Firing kiln
170 Faces of the roof tile 10 extending transversely to the pressing direction P
172 Reinforcement ribs
174 Transition regions
176 Faces of the roof tile 10 lying perpendicularly to the pressing direction P
178 Impression
200 Production installation
E Injection direction
P Pressing direction
R Removal direction

The invention claimed is:

1. A press mold for producing a roof tile from clay, having a first mold half and a second mold half, wherein the mold halves are movable relative to one another between a pressing position and a filling position;

in the pressing position the mold halves substantially delimit a receiving space that models the shape of the finished roof tile, and respective opposing surfaces of the first mold half and of the second mold half model in each case a corresponding surface of the roof tile, and in the filling position, the mold halves are spaced apart from one another so that a plastically deformable clay material can be filled into at least one of the first and the second mold half, wherein at least one of the first mold half and the second mold half has at least one recess that models a protrusion on the finished roof tile, and adjacent the recess, a first pressure element is provided, which is configured to be movable between a starting position, in which the first pressure element is set back with regard to the shape of the finished roof tile, and a compacting position, in which the first pressure element partially models the surface of the roof tile, wherein, on opposite faces of the recess, in each case at least one first pressure element is provided, wherein the opposite first pressure elements are coupled together hydraulically or via a controller.

2. The press mold as claimed in claim 1, wherein the first pressure element is provided at the foot of the recess.

3. The press mold as claimed in claim 1, wherein, at the surface of at least one of the first and the second mold half, at least one second pressure element is provided, which is configured to be movable between a starting position, in which the second pressure element protrudes or is set back with regard to the shape of the finished roof tile, and a compacting position, in which the second pressure element partially models the surface of the roof tile.

4. The press mold as claimed in claim 3, wherein at least one second pressure element is coupled to a first pressure element provided in the recess, wherein the coupling is configured such that, when the second pressure element moves from a protruding position into the compacting position, the coupled first pressure element is urged from the set-back position into the compacting position.

5. The press mold as claimed in claim 3, wherein at least one of the first pressure element and the second pressure element is a pressure pad that has a variable-volume pressure chamber that is fillable with an incompressible pressure medium, wherein a pressure line for feeding and/or discharging the pressure medium is provided.

6. The press mold as claimed in claim 5, wherein respective pressure lines of at least one first pressure element and at least one second pressure element are connected together.

7. The press mold as claimed in claim 5, wherein a pressure generating device for supplying the pressure medium is provided, wherein at least one pressure line is connected to the pressure generating device.

8. The press mold as claimed in claim 3, wherein the surface of at least one of the first and of the second mold half has a flexible coating, wherein at least one of the first and the second pressure element is arranged adjacent the coating.

9. The press mold as claimed in claim 1, wherein at least one of a plurality of first pressure elements and a plurality of second pressure elements are provided, wherein the first pressure elements and/or the second pressure elements are coupled together.

10. The press mold as claimed in claim 1, wherein the mold halves each have a main body made of tool steel.

11. The press mold as claimed in claim 1, wherein a guide for at least one of the first and the second mold half is provided, wherein the guide, together with the mold halves, fully delimits the receiving space in the filling position and in the pressing position.

12. The press mold as claimed in claim 11, wherein the press mold has vent holes.

13. The press mold as claimed in claim 1, wherein the press mold includes a filling apparatus for introducing a predried clay material, wherein the filling apparatus has a high-pressure injection device.

14. A method for producing a roof tile from clay, using a press mold that has a first mold half and a second mold half, wherein the mold halves are movable relative to one another between a pressing position and a filling position;

in the pressing position the mold halves substantially delimit a receiving space that models the shape of the finished roof tile, and respective opposing surfaces of the first mold half and of the second mold half model in each case a corresponding surface of the roof tile, and in the filling position, the mold halves are spaced apart from one another so that a plastically deformable clay material can be filled into at least one of the first and the second mold half, wherein at least one of the first mold half and the second mold half has at least one recess that models a protrusion on the finished roof tile, and adjacent the recess, a first pressure element is provided, which is configured to be movable between a starting position, in which the first pressure element is set back with regard to the shape of the finished roof tile, and a compacting position, in which the first pressure element partially models the surface of the roof tile, the method comprising the steps of:

providing the press mold, wherein the mold halves are located in the filling position and the at least one first pressure element is located in the starting position, filling a predried granular clay material into the receiving space, moving the mold halves into the pressing position, wherein the clay material is compacted, moving the at least one pressure element into the compacting position, wherein the clay material is compacted in the region of the first pressure element, wherein, following completion of the pressing operation, the first pressure element is moved into the starting position, then the mold halves are moved into the filling position, and the roof tile is removed from the press mold, and wherein a guide for at least one of the first and the second mold half is provided, wherein the guide, together with the mold halves, fully delimits the receiving space in the filling position and in the pressing position, wherein, before the mold halves are moved laterally into the filling position, the guide is moved laterally into a demolding position.

15. The method as claimed in claim 14, wherein, at the surface of the first and/or the second mold half, at least one second pressure element is provided, which is configured to be movable between a starting position, in which the second pressure element protrudes or is set back with regard to the shape of the finished roof tile, and a compacting position, in which the second pressure element partially models the surface of the roof tile, wherein, while or after the mold halves are moved into the pressing position, the second pressure element is moved into the compacting position.

16. The method as claimed in claim 15, wherein the second pressure element is coupled to a first pressure element provided in the recess, wherein, as a result of the second pressure element being moved from the protruding position into the compacting position, the coupled first pressure element is urged from the set-back position into the compacting position.

17. The method as claimed in claim 15, wherein at least one of the first and the second pressure element is a pressure pad that has a variable-volume pressure chamber that is fillable with an incompressible pressure medium, wherein a pressure line for feeding and/or discharging the pressure medium is provided, wherein the pressure elements are moved in each case by the pressure medium flowing into or out of the pressure chamber.

18. The method as claimed in claim 14, wherein a filling apparatus for introducing a predried clay material is provided, wherein the filling apparatus has a high-pressure injection device, wherein the filling apparatus injects the clay material under high pressure into the receiving space, wherein the clay material is precompacted.

19. The method as claimed in claim 18, wherein the clay material is injected in a direction extending substantially parallel to the surface of the first and/or the second mold half.

20. The method as claimed in claim 14, wherein, after the clay material has been filled in, the mold halves are moved into a venting position between the filling position and the pressing position, in which air contained in the receiving space escapes from the receiving space.

21. The method as claimed in claim 14, wherein the clay material is produced by the steps of:

providing moist, unprocessed clay, drying the clay to a defined moisture content, grinding the dried clay into crushed grain in a mill, and separating out the undersize, the grain size of which is below a defined granularity band, and separating out the oversize, the grain size of which is above a defined granularity band.

* * * * *